US006322669B1

(12) United States Patent
Leinonen

(10) Patent No.: US 6,322,669 B1
(45) **Date of Patent: *Nov. 27, 2001**

(54) METHOD AND ARRANGEMENT IN A WEB FORMER FOR PREVENTING REWETTING OF A WEB

(75) Inventor: Antti Leinonen, Laukaa (FI)

(73) Assignee: Valmet Corporation, Helsinki (FI)

( * ) Notice: Subject to any disclaimer, the term of this patent is extended or adjusted under 35 U.S.C. 154(b) by 0 days.

This patent is subject to a terminal disclaimer.

(21) Appl. No.: 09/499,946

(22) Filed: Feb. 8, 2000

Related U.S. Application Data

(6362) Continuation-in-part of application No. 09/068,145, filed as application No. PCT/FI97/00487 on Aug. 22, 1987, now Pat. No. 6,071,381.

(30) Foreign Application Priority Data

Sep. 6, 1996 (FI) ..... 963494

(51) Int. Cl.[7] ..... D21F 1/48
(52) U.S. Cl. ..... 162/217; 162/306; 162/363
(58) Field of Search ..... 162/306, 307, 162/202, 217, 363, 364

(56) References Cited

U.S. PATENT DOCUMENTS

| | | | |
|---|---|---|---|
| 2,714,342 | 8/1955 | Beachler | 162/370 |
| 2,843,025 | 7/1958 | Holden | 162/306 |
| 3,758,380 | 9/1973 | Hawkings | 162/306 |
| 4,980,979 | 1/1991 | Wedel | 34/23 |
| 5,034,100 | 7/1991 | Sides | 162/306 |
| 6,071,381 * | 6/2000 | Leinonen | 162/306 |

FOREIGN PATENT DOCUMENTS

| | | | |
|---|---|---|---|
| 0371786 | 6/1990 | (EP) | D21F/1/48 |

OTHER PUBLICATIONS

Zoltan Szikla, et al., "Role of felt in wet pressing", Paper and Timer vol. 73, (1991), pp. 260–266.

* cited by examiner

*Primary Examiner*—Karen M. Hastings
(74) *Attorney, Agent, or Firm*—Steinberg & Raskin, P.C.

(57) ABSTRACT

A method and arrangement for preventing rewetting of a web in a paper machine. In the method, a web supported by a wire is passed by at least two vacuum boxes/chambers after the last suction roll or equivalent in a web former such that, in the running direction of the web, by means of a first vacuum box/chamber and by means of a second vacuum box/chamber the transport of moisture from the wire back into the web is prevented. In the arrangement at least two vacuum boxes/chambers are arranged after the last suction roll or equivalent in a web former, and the web and wire are arranged to be dewatered by means of a first vacuum box/chamber and the transport of moisture from wire back into the web is prevented by means of a second vacuum box/chamber, the vacuum generated in first vacuum box/chamber being higher than the vacuum generated in the second vacuum box/chamber.

29 Claims, 4 Drawing Sheets

METHOD AND ARRANGEMENT IN A WEB FORMER FOR PREVENTING REWETTING OF A WEB

CROSS-REFERENCE TO RELATED APPLICATION

This application is a continuation-in-part of U.S. patent application Ser. No. 09/068,145 filed May 4, 1998 now U.S. Pat. No. 6,071,381, which claims priority of Finnish Patent Application No. 963494 filed Sep. 6, 1996, and which is a 371 of International Application No. PCT/FI97/00487 filed Sep. 22, 1997.

FIELD OF THE INVENTION

The present invention relates to a method for preventing rewetting of a web in a web former. In the method of the present invention water is removed from the web by means of dewatering members and the web is formed by means of forming members and forming rolls on support of a wire loop/loops, and in which method the wire loop/loops is/are guided by means of alignment, guide and/or suction rolls.

The present invention also relates to an arrangement for preventing rewetting of a web in web former, which web former comprises web forming members and web forming rolls, dewatering members and a wire loop/loops as well as alignment, guide and suction rolls for the wire loop/loops.

BACKGROUND OF THE INVENTION

In the oldest methods of forming a continuous paper or bard web, which are still most commonly applied, forming of the web takes place in a horizontal so-called fourdrinier wire section, or a planar wire section. In addition, two main groups may be distinguished amount the wire sections, or former types, namely actual twin-wire formers and so called hybrid formers. In the actual twin-wire formers, forming of the web takes place from beginning to end between two wires. In the hybrid formers, the web is formed first onto one wire, after which this partly formed web is passed to a dewatering zone that is being formed between tow wires for final stabilization of the fibers.

One problem in the formers known from the prior art is rewetting of the web. For instance, when a suction box of high vacuum is used in a former, even after the box rewetting of the web still occurs, before the transfer of the web to the press section. On the other hand, it is known that wires at all times carry water in an amount of their own mass under normal running conditions, said water tending to move into the web if there is no force or other arrangement to prevent it.

Conventionally, vacuum zones, for instance in suction rolls, have been arranged to increase in suction, e.g. the first chamber of 25 kPa and the second chamber of 66 kPa in the case where attempts are made to increase the solids proportion without clogging up the web. A suction box of high vacuum usually arranged so that it is the last dewatering element in the former. It is known that solids may be increased by a high vacuum, but it is difficult to maintain the obtained solids.

With respect to the prior art, reference may be made to the magazine article of *Szikla, Palokangas, Rolefelt in wetpressing, Paperija Puu* 73, 1991, reporting an investigation of press felts in which it was observed that a vacuum of 20–40 kPa is enough to hold water in the felt after a nip, thereby minimizing rewetting in a press. The result has been obtained with modern felts, in which the resistance to flow is small.

With respect to prior art, reference may also be made to EP Patent Application No. 0 371 768, which discloses a web forming method and apparatus, said method being applied in a wire section of a paper machine or equivalent, in which the wire section is formed by a bottom wire loop with the main portion of its top run being substantially horizontal and a top wire loop cooperating therewith, and in which method a fiber suspension coming out of a headbox of the paper machine is supplied to the first part of the top run of said bottom wire loop, said part forming a first dewatering zone, after which the fiber layer from which part of the water has been removed is passed to a second dewatering zone in which said top wire loop covers the fiber layer, from which part of the water has been removed, such that the removal of the water from the fiber layer continues at least in two stages in the area of said second dewatering zone, after which the top wire loop is separated from the nearly formed fiber web, which is guided to follow the run of the bottom wire loop forwards for the following processing stages of the web. In connection with this prior-art arrangement a separation suction box has been used in the downwards slanting run of the bottom wire between a forming roll and a suction roll, the purpose of said suction box being to ensure that the web does not follow the wire, which returns to the wire section, but rather is transferred from the wire section to a press section. In this known arrangement of the web, supported by the bottom wire and ensured by the suction box, moves over the suction roll to the run between ti and the drive roll of the wire, from which the web is transferred, in a way known in itself, by means of a pick-up roll and a felt forwards to the press section of the paper machine. However, in this arrangement no attention has been paid to the prevention of rewetting.

OBJECTS AND SUMMARY OF THE INVENTION

It is therefore an object of the present invention to disclose an arrangement by which rewetting of the web is prevented.

It is another object of the present invention to ensure sufficient solids content when transition is made from a wire section to a press section, thereby enabling the speed of the paper machine to be increased.

In view of the foregoing objectives, as well as other discussed herein, the method according to the present invention is mainly characterized in that, in the method, a web supported by a wire is passed by at least two vacuum boxes/chambers after the last suction roll or equivalent in a web former such that, in the running direction of the web, by means of a first vacuum box/chamber and by means of a second vacuum box/chamber the transport of moisture from the wire back into the web is prevented.

The arrangement of the present invention is mainly characterized in that at least two vacuum boxes/chambers are arranged after the last suction roll or equivalent in a web former, and the web and wire are arranged to be dewatered by means of a first vacuum box/chamber and the transport of moisture from wire back into the web is prevented by means of a second vacuum box/chamber, the vacuum generated in first vacuum box/chamber being higher than the vacuum generated in the second vacuum box/chamber.

In accordance with the invention rewetting of the web is prevented such that the water adhering to the threads and the bottom face of the wire is prevented from traveling to the upper face of the wire and coming into contact with the web.

This arrangement also makes it possible to optimize the vacuum in the high-vacuum chamber. The vacuum may then be dropped, if needed, after rewetting is no problem. In addition, the vacuum in the chamber of the lower vacuum may be also minimized to a point where no rewetting occurs.

If needed, the chamber on the outlet side, or the chamber of the lower vacuum, is divided into transverse sections, which can be regulated together and or separately, in which case, for instance the edges of the web may be treated differently from the middle part of the web.

BRIEF DESCRIPTION OF THE DRAWINGS

Additional objects of the invention will be apparent from the following description of the preferred embodiment thereof taken in conjunction with the accompanying non-limiting drawings, in which.

DETAILED DESCRIPTION OF THE PREFERRED EMBODIMENTS

Figure 1:
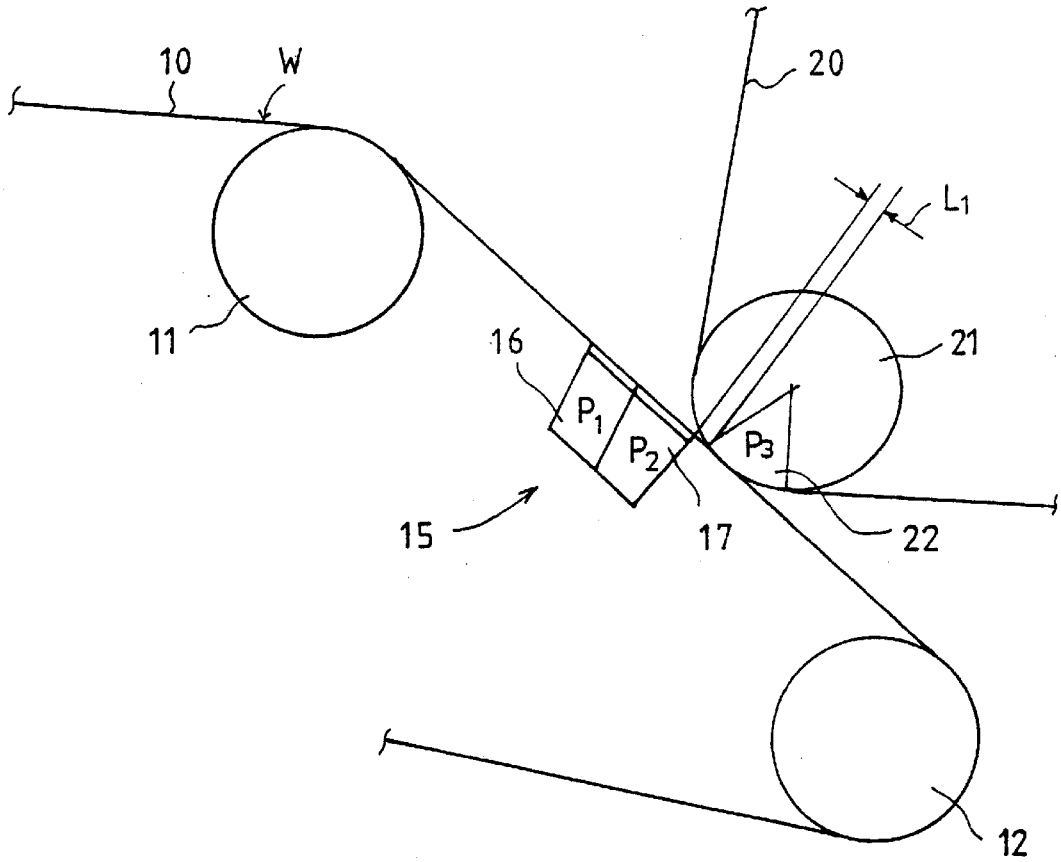
FIG. 1 is a schematic illustration showing the arrangement of the present invention in wire section of a paper machine.

FIG. 1 depicts the arrangement of the present invention at the end of a wire section of a paper machine, just before the transition to the press section. A wire of the wire section is denoted by reference numeral 10 and a wire of the press section is denoted by the reference numeral 20. From the last suction roll 11 of the wore section the wire 10 leads the web by a suction box 15, which comprises a first high-pressure suction chamber 16 having a vacuum $P_1$, of about 45 to about 75 kPa, preferably from about 50 to about 65 kPa, and it is followed by a chamber 17 of lower vacuum, by which rewetting is inhibited. The vacuum $P_2$ generated by this chamber is about 15 to about 45 kPa, preferably about 35 to about 40 kPa. The vacuum level of the second suction zone is selected so that water is maintained on a lower face of the wire 10 while maintaining an upper face of the wire 10 substantially free from water. In this manner, the transfer of water back into the web (rewetting) is prevented. After that there is a pick up roll 21 of the wire section, whose suction zone is denoted by the reference numeral 22, said suction zone having a vacuum denoted by $P_3$, said vacuum being about 25 to about 45 kPa, preferably about 30 to about 35 kPa. In accordance with the invention, the chamber 17 of lower vacuum and the suction zone of the pick-up roll are as close to each other as possible. The distance $L_1$ may be for instance, $L_1$=0–500 mm, preferably $L_1$=0–100 mm.

Figure 4:
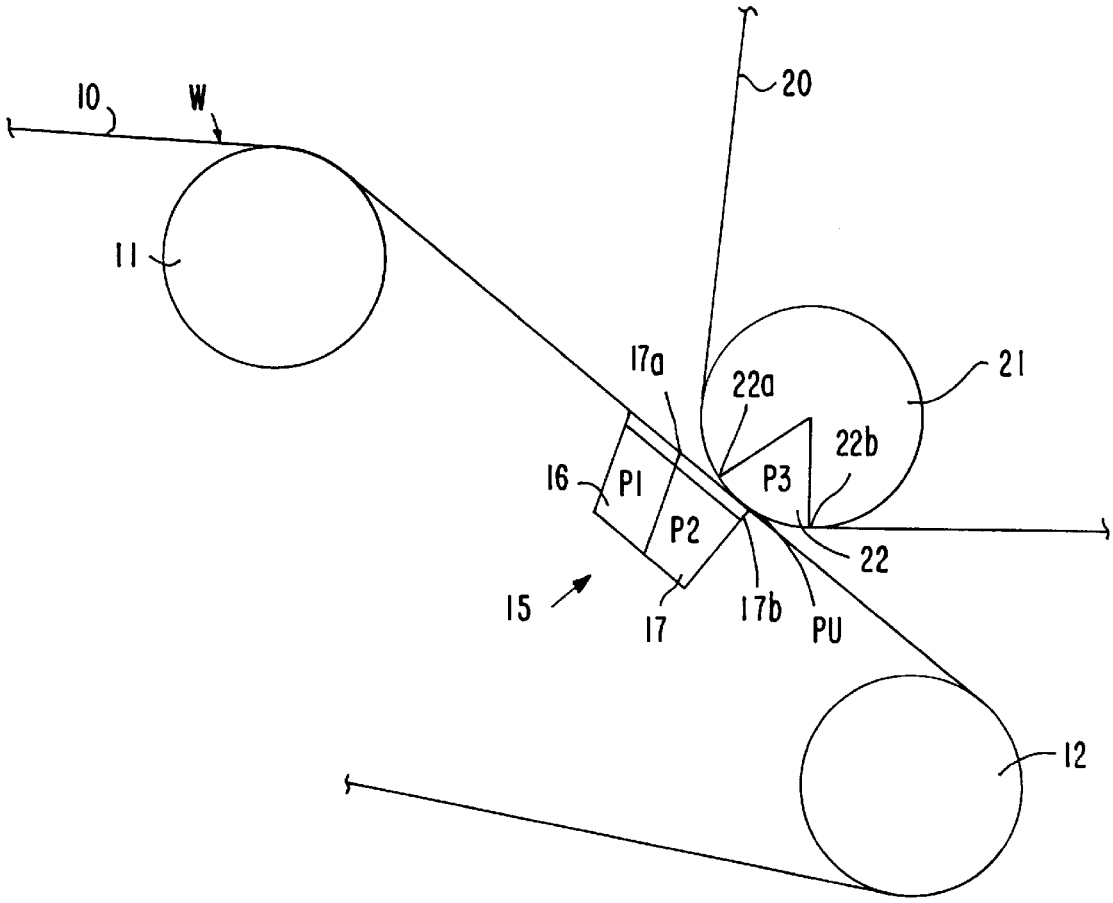
FIG. 4 is a schematic illustration showing an embodiment of the arrangement of the present invention in which the second vacuum box/chamber is arranged in overlapping fashion with a suction zone of a pick up roll arranged in the press section.

The chamber 17 of lower vacuum may be arranged in overlapping relationship with the suction zone 22 of the pick up roll (i.e. so that $L_1$ has a negative value). For example, as shown in FIG. 4, the chamber 17 of lower vacuum may be arranged in face to face alignment so that the leading edge 17*a* of the chamber 17 is arranged prior to the leading edge 22*a* of the suction zone 22 and the trailing edge 17*b* of the chamber is arranged after the leading edge 22*a* and prior to the trailing edge 22*b* of the suction zone 22. The chamber 17 may also be arranged so that the leading edge 17*a* and trailing edge 17*b* of the chamber 17 are positioned between the leading edge 22*a* and trailing edge of the 22*b* of the suction zone 22. Finally, chamber 17 may be arranged so that a portion thereof extends beyond the suction zone 22, i.e. so that trailing edge 17*b* extends beyond the trailing edge 22*b* of the suction zone 22. In this final case, the leading edge 17*a* may be arranged either prior to or within the suction zone 22, that is before the leading edge 22*a* or between the leading edge 22*a* and trailing edge 22*b*.

In operation, the web (W) passes over at least a portion of the second chamber 17 prior to the pick up point (PU), that is prior to the point where the web separates from wire 10 and transfers to wire 20 of the press section. Preferably, as shown in FIG. 4, the web passes over the entirety of the second chamber 17 prior to the pick up point (PU).

When the second chamber 17 is arranged in overlapping relationship with the suction zone 22 of the pick up roll, as described above, the cover of the chamber 17 may be constructed from a flexible material thereby enabling the wire the bend in the curvature required by the radius of the pick roll. In this way slight play is introduced into this system thereby avoiding the problems associated with a hard nip, i.e. breakage of the web and/or wire.

Figure 2:
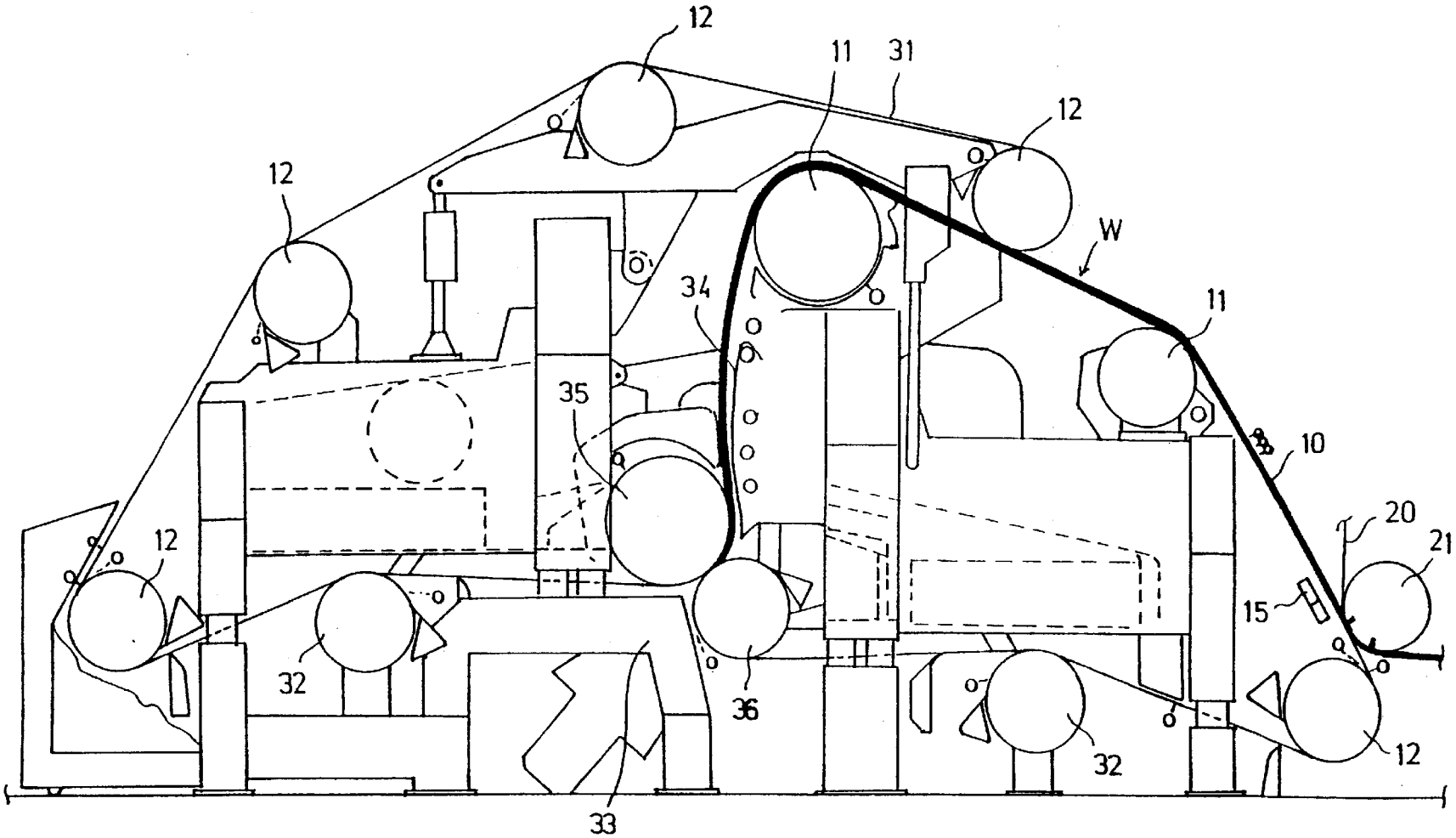
FIGS. 2 and 3 are schematic illustrations showing formers of different type, in connection with which the arrangement of the present invention may be applied.
Figure 3:
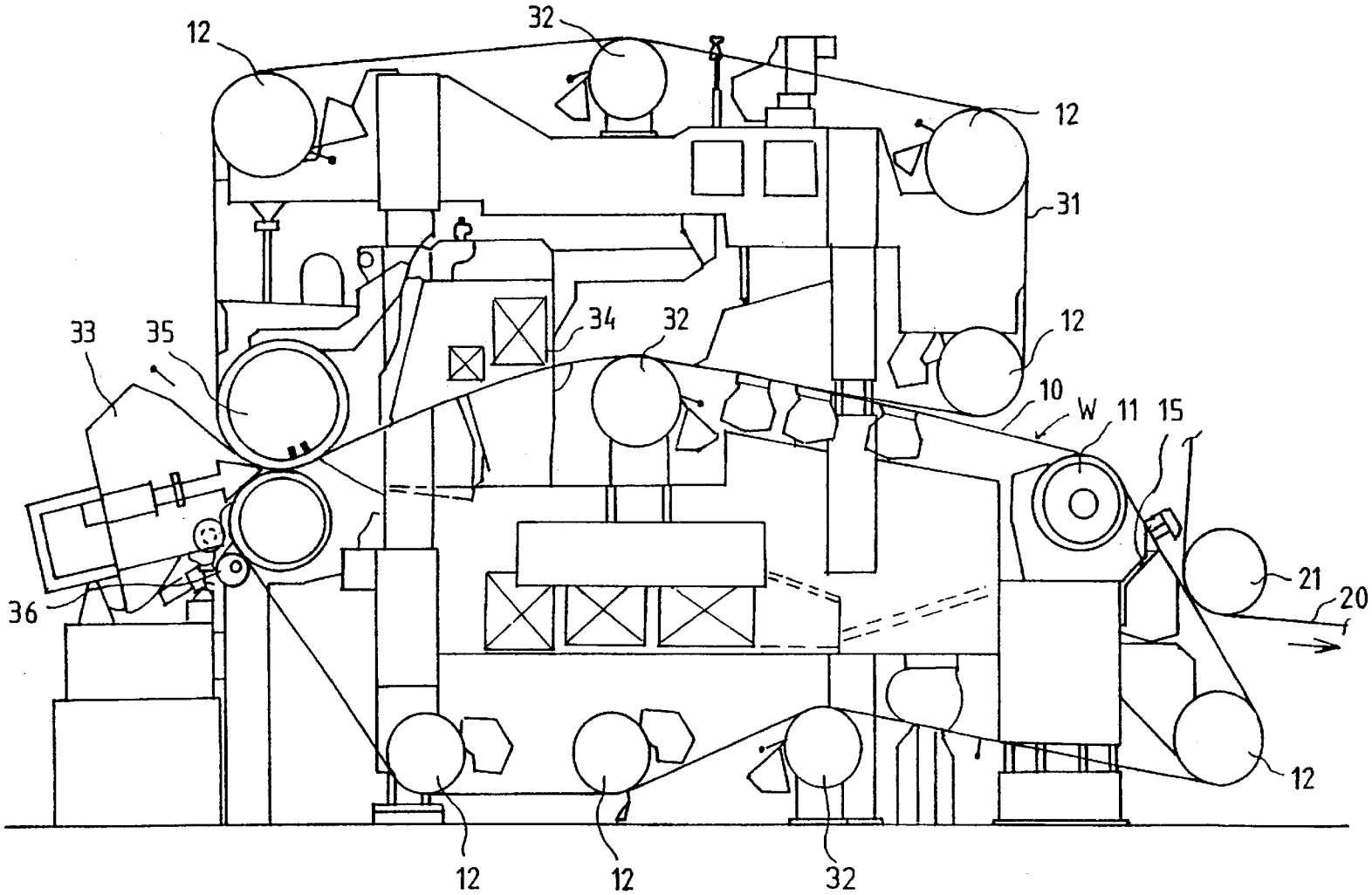

FIGS. 2 and 3 schematically depict a wire section of a paper machine including the arrangement of the present invention to prevent rewetting of the web during transition from the wire section to the press section. The parts corresponding to those of FIG. 1 have been denoted with the same reference numerals and the parts corresponding to those show in FIGS. 2 and 3 having been denoted with the same reference numerals as used therein.

In the web formers shown in FIG. 2 and 3, the web is formed between wire loops 10 and 31 which wire loops are provided with alignment, guide and suction rolls 32, 12 and 11. Pulp is supplied from a headbox 33 onto an initial portion of one wire loop 10, after which water is removed from pulp by means of dewatering members 34. The web is formed by forming rolls 35 and the breast roll of the web former is denoted with reference numeral 36. A suction box 15 in accordance with the invention is disposed after the last suction roll 11, after which the web is guided to a press section.

The arrangement in accordance with the invention for preventing rewetting of the web is, of course, suitable for use in connection with wire sections of other types other than those illustrated in FIGS. 2 and 3 provided that the end of the wire section before the web is transferred to a press section is arranged in structure that the arrangement of the invention can be disposed there just before or at the pick up roll. For instance, in such a way that the distance $L_1$=0–500 mm or the arrangement extends so as to be at the pick up aperture, preferably at it or $L_1$=0–100 mm.

In the following, the patent claims will be given, and the various details of the invention can show variation within the scope of the inventive idea defined in the claims and differ even to a considerable extent from the details stated above by way of example only. As such, the examples provided above are not meant to be exclusive and many other variations of the present invention would be obvious to those skilled in the art, and are contemplated to be within the scope of the appended claims.

I claim:

1. A method for preventing rewetting of a web in a web former of a paper machine in which the web is formed by forming members while being supported by a wire and water is removed from the web by dewatering members, the wire being guided in a loop by alignment, guide and/or suction rolls, the improvement comprising the steps of:

arranging at least a first and second vacuum box/chamber in a loop of the wire after a last one of the alignment, guide and/or suction rolls in a running direction of the web prior to separation of the web from the wire such that the web passes over the last roll and then over said first vacuum box/chamber and at least a portion of said second vacuum box/chamber prior to said web separating from said wire, generating a first vacuum of about 45 kPa to about 75 kPa in said first vacuum box/chamber in order to remove moisture from the wire and the web supported thereby, generating a second vacuum of about 15 kPa to about 45 kPa in said second vacuum box/chamber to prevent transport of moisture from the wire back into the web, and regulating the first and second vacuums such that the first vacuum is higher than the second vacuum, whereby rewetting of the web is prevented such that the water adhering to the threads and the bottom face of the wire is prevented from traveling to the upper face of the wire and coming into contact with the web.

2. The method of claim 1, wherein said second vacuum has a selected vacuum level so that an upper face of said wire is maintained substantially free from water.

3. The method of claim 1, wherein said second suction box/chamber is arranged in overlapping relationship with a suction zone of a pick up roll in a press section of said paper machine.

4. The method of claim 3, wherein said second suction box/chamber is arranged so that a leading edge of the second suction box/chamber is arranged prior to a leading edge of the suction zone and a trailing edge of the suction box/chamber is arranged after the leading edge of the suction zone and before a trailing edge of the suction zone.

5. The method of claim 3, wherein said second suction box/chamber is arranged so that a leading edge and trailing edge of said second suction box/chamber are arranged between a leading edge and trailing edge of said suction zone.

6. The method of claim 3, wherein said second suction box/chamber is arranged so that a leading edge of said second suction box/chamber is arranged prior to a leading edge of said suction zone and a trailing edge of said second suction box/chamber is arranged between said leading edge of said suction zone and a trailing edge of said suction zone.

7. The method of claim 3, wherein said second suction box/chamber is arranged so that a leading edge of said second suction box/chamber is arranged before a leading edge of said suction zone and a trailing edge of said second suction box/chamber is arranged after a trailing edge of said suction zone.

8. The method of claim 3, wherein said second suction box/chamber is arranged so that said web passes over a portion of said second suction box/chamber prior to a pick up point of said pick up roll.

9. The method of claim 3, wherein said second suction box/chamber is arranged so that said web passes over the entirety of said second suction box/chamber prior to a pick up point of said pick up roll.

10. The method of claim 1, wherein two of the alignment, guide or suction rolls are arranged to define a substantially straight run for the wire along which the web is separated from the wire, the at least first and second vacuum boxes/chambers being arranged along the substantially straight run prior to separation of the web from the wire.

11. The method of claim 1, further comprising the step of dividing said second vacuum box/chamber into sections in a direction transverse to the running direction of the web such that an independently regulatable level of suction may be generated in each of said sections.

12. The method of claim 1, wherein a vacuum of about 50 kPa to about 65 kPa is generated in said first vacuum box/chamber.

13. The method according to claim 1, wherein a vacuum of about 35 kPa to about 40 kPa is generated in said second vacuum box/chamber.

14. In a web former of a paper machine including web forming members for forming a web, dewatering members for dewatering the web, a wire and alignment, guide and/or suction rolls for guiding the wire in a loop to support the web, an arrangement for preventing rewetting of the web comprising:

at least a first and second suction box/chamber arranged in a loop of the wire after a last one of the alignment, guide and/or suction rolls in a running direction of the web prior to separation of the web from the wire such that the web is passed while supported by the wire over the last roll, over the first vacuum box/chamber and over at least a portion of said second suction box/chamber, said at least first and second vacuum boxes/chambers being structured and arranged such that a first vacuum of about 45 kPa to about 75 kPa is generated in said first vacuum box/chamber in order to remove moisture from the wire and the web supported thereon and a second vacuum of about 15 kPa to about 45 kPa is generated in said second vacuum box/chamber to prevent transport of moisture from the wire back into the web, the first and second vacuums being such that the first vacuum is higher than the second vacuum, whereby rewetting of the web is prevented such that the water adhering to the threads and the bottom face of the wire is prevented from traveling to the upper face of the wire and coming into contact with the web.

15. The arrangement of claim 14, wherein said second vacuum has a selected vacuum level so that an upper face of said wire is maintained substantially free from water.

16. The arrangement of claim 14, wherein said second vacuum box/chamber is structured and arranged in overlapping relationship with a suction zone of a pick up roll in a press section of said paper machine.

17. The arrangement of claim 14, wherein said second suction box/chamber is structured and arranged so that a leading edge of the second suction box/chamber is arranged prior to a leading edge of the suction zone and a trailing edge of the suction box/chamber is arranged after the leading edge of the suction zone and before a trailing edge of the suction zone.

18. The arrangement of claim 14, wherein said second suction box/chamber is structured arranged so that a leading edge and trailing edge of said second suction box/chamber are arranged between a leading edge and trailing edge of said suction zone.

19. The arrangement of claim 14, wherein said second suction box/chamber is structured and arranged so that a leading edge of said second suction box/chamber is arranged prior to a leading edge of said suction zone and a trailing edge of said second suction box/chamber is arranged between said leading edge of said suction zone and a trailing edge of said suction zone.

20. The arrangement of claim 14, wherein said second suction box/chamber is structured and arranged so that a leading edge of said second suction box/chamber is arranged before a leading edge of said suction zone and a trailing edge of said second suction box/chamber is arranged after a trailing edge of said suction zone.

21. The arrangement of claim 14, wherein said second suction box/chamber is arranged so that said web passes over portion of said second suction box/chamber prior to a pick up point of said pick up roll.

22. The arrangement of claim 14, wherein said second suction box/chamber is arranged so that said web passes over the entirety of said suction box/chamber prior to a pick up point of said pick up roll.

23. The arrangement of claim 14, wherein two of the alignment, guide or suction rolls are arranged to define a substantially straight run for the wire along which the web is separated from the wire, said at least two vacuum boxes/chambers being arranged along the substantially straight run prior to separation of the web.

24. The arrangement of claim 14, wherein said second vacuum box/chamber is divided into sections in a direction transverse to the running direction of the web such that an independently regulatable level of suction may be generated in each of said sections.

25. The arrangement of claim 14, wherein a vacuum of about 50 kPa to about 65 kPa is generated in said first vacuum box/chamber.

26. The arrangement of claim 14, wherein a vacuum of about 35 kPa to about 40 kPa is generated in said second vacuum box/chamber.

27. In a web former including web forming members for forming a web, dewatering members for dewatering the web, a wire and alignment, guide and/or suction rolls for guiding the wire in a loop to support the web, an arrangement for preventing rewetting of the web comprising:

at least a first and second suction box/chamber arranged in a loop of the wire after a last one of the alignment, guide and/or suction rolls in a running direction of the web prior to separation of the web from the wire such that the web is passed while supported by the wire over the last roll, over the first vacuum box/chamber and over at least a portion of said second suction box/chamber, said at least first and second vacuum boxes/chambers being structured and arranged such that a first vacuum of about 45 kPa to about 75 kPa is generated in said first vacuum box/chamber in order to remove moisture from the wire and the web supported thereon and a second vacuum of about 45 kPa to about 75 kPa is generated in said second vacuum box/chamber to prevent transport of moisture from the wire back into the web, the first and second vacuums being such that the first vacuum is higher than the second vacuum and said second vacuum having a selected vacuum level for maintaining water on a lower face of said wire while maintaining an upper face of said wire substantially free from water, whereby rewetting of the web is prevented such that the water adhering to the threads and the bottom face of the wire is prevented from traveling to the upper face of the wire and coming into contact with the web.

28. The arrangement of claim 27, wherein a vacuum of about 50 kPa to about 65 kPa is generated in said first vacuum box/chamber.

29. The arrangement of claim 27, wherein a vacuum of about 35 kPa to about 40 kPa is generated in said second vacuum box/chamber.

* * * * *

UNITED STATES PATENT AND TRADEMARK OFFICE

CERTIFICATE OF CORRECTION

PATENT NO. : 6,322,669 B1
DATED : November 27, 2001
INVENTOR(S) : Leinonen

It is certified that error appears in the above-identified patent and that said Letters Patent is hereby corrected as shown below:

Title page,
Item [63], under "Related U.S. Application Data", change date for Application No. PCT/F197/00487 from "August 22, 1987" to -- August 22, 1997 --.

Signed and Sealed this

Second Day of July, 2002

*Attest:*

*Attesting Officer*

JAMES E. ROGAN
*Director of the United States Patent and Trademark Office*